US005184897A

United States Patent [19]

Gozdenovich et al.

[11] Patent Number: 5,184,897

[45] Date of Patent: Feb. 9, 1993

[54] GIFT BAG

[76] Inventors: Martin Gozdenovich, 275 W. Mountain Rd.; Martin A. Gozdenovich, 37 Signal Hill Trail; David Gozdenovich, 275 W. Mountain Rd.; Guy Zimmermann, 38 Meredith Ave.; Glenn Pierson, 541 W. Mountain Rd., all of Sparta, N.J. 07871

[21] Appl. No.: 714,514

[22] Filed: Jun. 13, 1991

[51] Int. Cl.[5] ..... B65D 33/28

[52] U.S. Cl. ..... 383/75; 383/120

[58] Field of Search ..... 383/75, 76, 72, 71, 383/120

[56] References Cited

U.S. PATENT DOCUMENTS

| | | | |
|---|---|---|---|
| 3,552,639 | 1/1971 | Meyer | 383/75 |
| 3,746,066 | 7/1973 | McIntyre | 383/75 X |
| 3,920,180 | 11/1975 | Meier | 383/75 |
| 3,977,448 | 8/1976 | Botting | 383/75 X |
| 4,493,683 | 1/1985 | Jostler | 383/75 X |
| 4,608,283 | 8/1986 | White | 383/76 X |
| 4,777,066 | 10/1988 | White et al. | 383/76 X |
| 4,930,905 | 6/1990 | Sharps | 383/75 |

FOREIGN PATENT DOCUMENTS

| | | | |
|---|---|---|---|
| 1907049 | 9/1969 | Fed. Rep. of Germany | 383/75 |
| 2215612 | 10/1973 | Fed. Rep. of Germany | 383/75 |
| 379734 | 11/1907 | France | 383/75 |
| 1582939 | 10/1969 | France | 383/75 |
| 2299962 | 9/1976 | France | 383/6 |

*Primary Examiner*—Allan N. Shoap
*Assistant Examiner*—Jes F. Pascua
*Attorney, Agent, or Firm*—Bernard J. Murphy

[57] ABSTRACT

Sheets of flexible, compliant polymer film are sealed together along common, bottom and side edges thereof, to define a bag with an open top, and the upper portion of the bag has a dual thickness. The latter, dual thickness defines a hem, and the hem has a channel formed therein in which are confined draw ribbons or ties, the ends of the ties are fixed to sides of the bag. Apertures formed in the sheets provide access to the ties, in order that the same can be drawn taut, severed, and formed into bows.

10 Claims, 3 Drawing Sheets

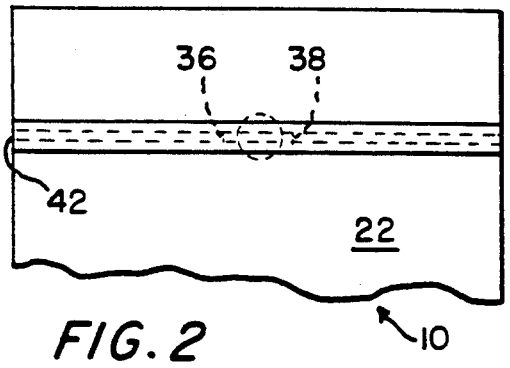
FIG. 2
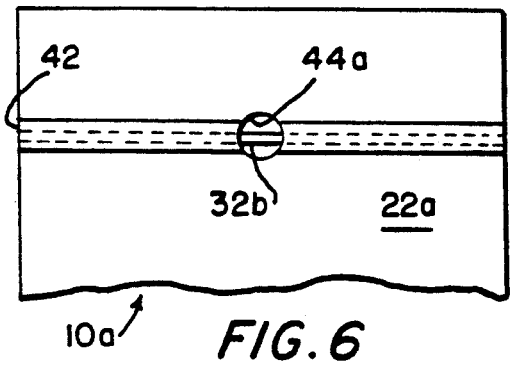
FIG. 6
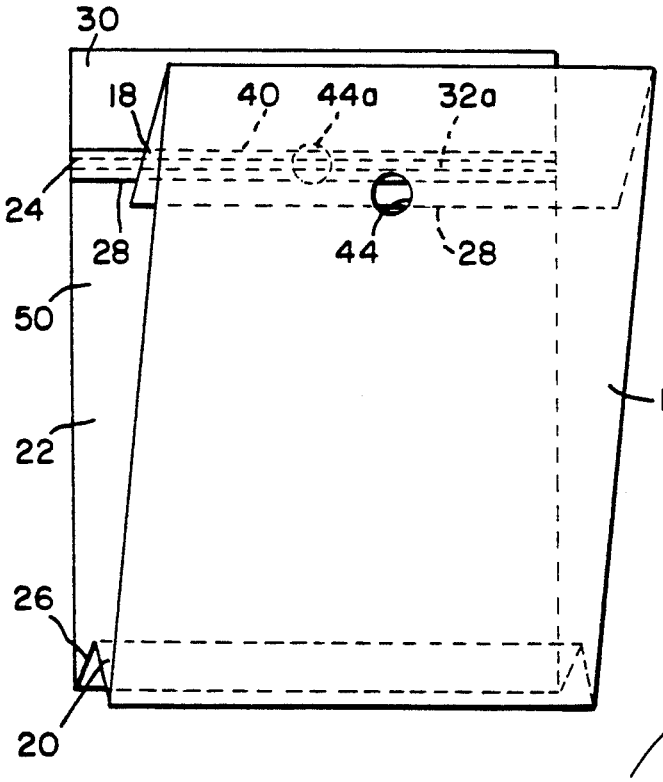
FIG. 7
FIG. 5
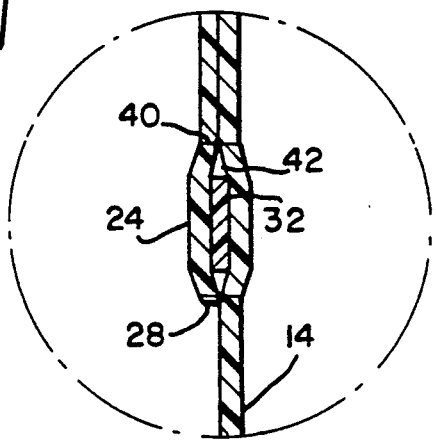

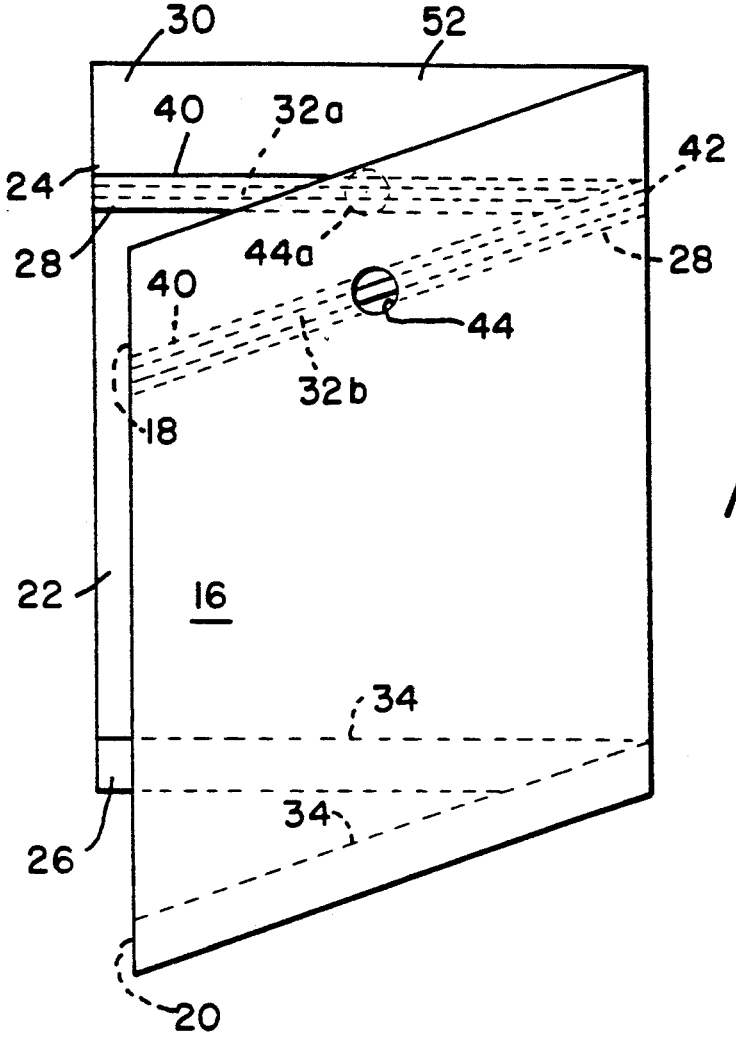
FIG. 8
FIG. 9
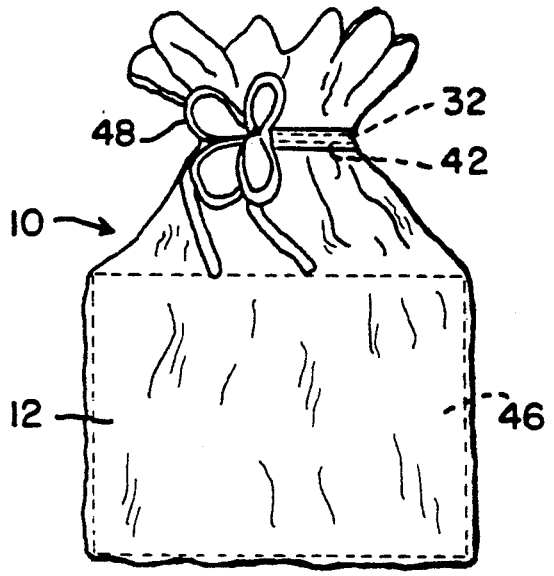

GIFT BAG

This invention pertains to flexible and compliant bags, sacks, and the like, having open tops, for confining packages therewithin, and in particular to a gift bag, i.e., a bag specially configured and constructed to define thereof a bag suitably and attractively formed for gift giving.

It is an object of this invention, then, to set forth a gift bag comprising a bag formed of a rectangular sheet of flexible, compliant material folded up upon itself, and sealed along two, aligned, opposite lateral edges thereof, to define said bag with closed sides, an open top, and a closed bottom; wherein said sheet has a prescribed, overall length, and a prescribed, overall width which is from approximately sixteen percent to approximately twenty-seven percent of said prescribed length; said sheet comprises front and rear, overlying panels having the aforedescribed width, and a given length which is from approximately thirty-three percent to approximately forty percent of said prescribed length; and an upper portion of said bag, extending from said open top thereof, has two thicknesses of said material.

It is also an object of this invention to disclose a gift bag comprising a bag formed of two, overlying, rectangular sheets of flexible, compliant material sealed together along three, common edges thereof, namely: bottom edges, and both side edges, to define said bag with only an open top; wherein each of said sheets has a prescribed, overall length, and a prescribed, overall width which is from approximately thirty-three percent to approximately sixty-five percent of said length; said sheets comprise front and rear, overlying panels having the aforesaid prescribed width, and a given length which is from approximately sixty-five percent to approximately eight percent of said prescribed length; and an upper portion of said bag, extending from said open top thereof, has two thicknesses of said material.

Further objects of this invention, as well as the novel features thereof, will become apparent from the following description thereof, taken in conjunction with the accompanying figures, in which:

FIG. 2 is a lay flat depiction of the gift bag of FIG. 1, albeit showing only a portion thereof, showing the top of the rear panel thereof;

FIG. 5 is a greatly enlarged detail of the dashed-line, circled area of FIG. 4;

FIG. 6 is a depiction, like that of FIG. 2, showing a portion of the top of the rear panel of an alternative embodiment of the invention;

FIGS. 7 and 8 illustrate sheets used in the formation of the novel gift bag, according to alternate embodiments of the same; and FIG. 9 is an illustration of the gift bag, according to the first embodiment thereof, with a package confined therewithin, and the ribbon-tie drawn through the aperture in the front panel, severed, and tied into a bow.

Figure 1:
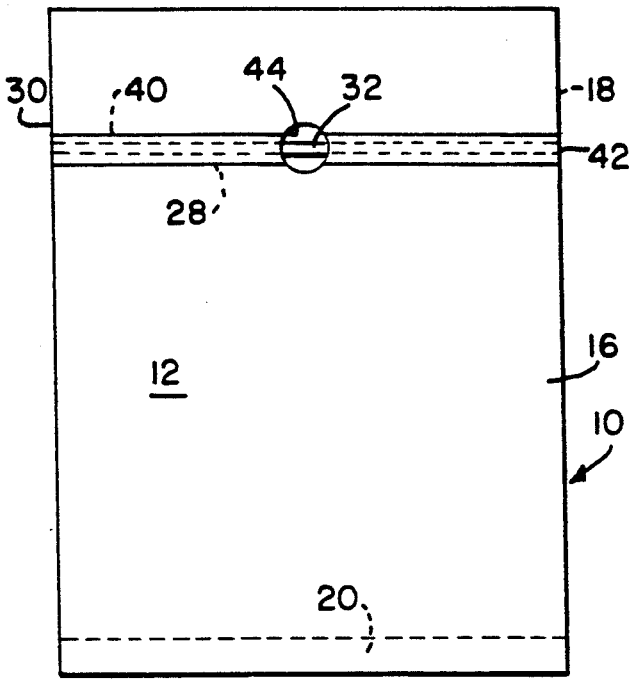
FIG. 1 is a lay flat depiction of the novel gift bag, according to an embodiment thereof, the same showing the front panel thereof.
Figure 4:
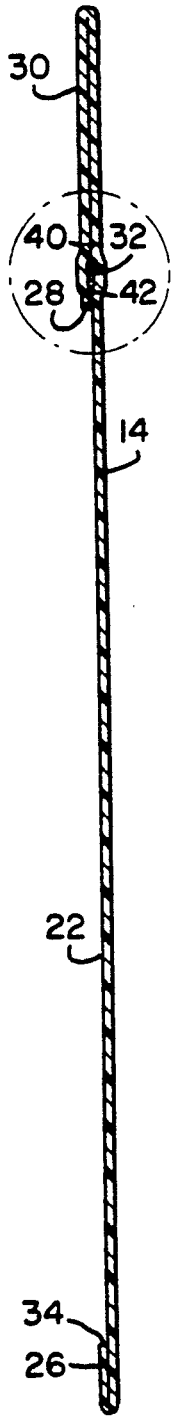
FIG. 4 is a cross-sectional view, taken along section 4—4 of FIG. 3, in twice the scale of FIG. 3, however.
Figure 3:
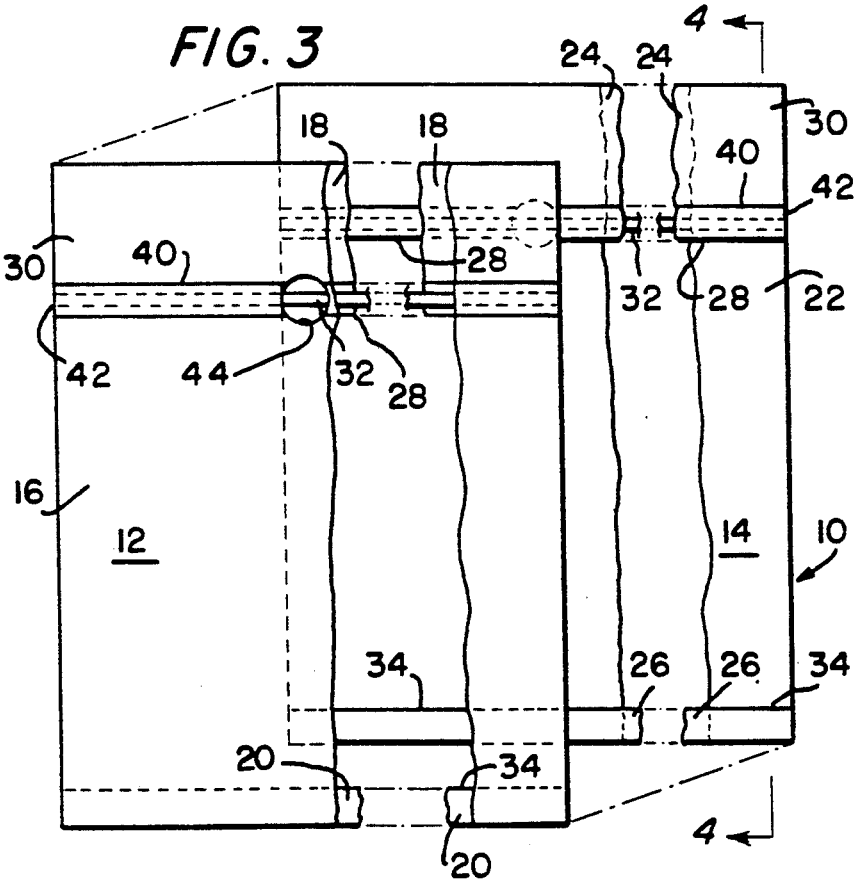
FIG. 3 is an exploded view of the gift bag of FIGS. 1 and 2, showing the sheets interrupted across the widths thereof for clarity of depiction.

As shown in FIGS. 1 through 5, a first embodiment 10 of the gift bag comprises two sheets 12 and 14 of heat-sealable polymer film which are used in forming the gift bag. Each sheet has a width of from approximately two inches to approximately sixty-five inches, and a length of from approximately six inches to approximately one hundred and twenty inches, depending upon how large it is desired to have the gift bag. Sheet 12 comprises a front panel 16, an integral end portion 18 at one end thereof, and an integral flap 20 at the opposite end thereof. Similarly, sheet 14 comprises a rear panel 22, an integral end portion 24 at one end thereof, and an integral flap 26 at the opposite end thereof. The end portions 18 and 24 have a width of from approximately one and three-eighths inch to approximately sixteen and three-quarters inches, whereas the flaps 20 and 26 range from approximately one inch in width to approximately ten inches in width.

The terminal edges 28 of the end portions 18 and 24 are folded back upon themselves only once, and are heat-sealed to their own, respective sheets, viz., sheet 12 and sheet 14, respectively, thereby to form hems 30 at the upper portions of the sheets, and to give the upper portions only dual thicknesses of the film. A ribbon-tie 32 is set into the hems 30, after the sheets 12 and 14 are joined together. In this, lateral edges of the end portions 18 and 24, panels 16 and 22, and the flaps 20 and 26 are heat sealed together, and the terminal edges 34 of the flaps 20 and 26 are also heat sealed together. Ends 36 and 38 of the ribbon-tie are heat sealed to the rear panel 22, in approximately the center thereof, and the closed loop of the ribbon-tie is set against the heat-sealed edges 28 of the end portions 18 and 24. The end portions 18 and 24, further, are heat-sealed again to their own, respective sheets 12 and 14, along a seal line 40 which runs parallel to the sealed, terminal edges 34, to define a channel 42 within each of the hems 30.

The front panel 16, in about the center thereof, has an aperture 44 formed therein which opens onto the channel 42 and exposes the ribbon-tie 32. In use, the gift bag embodiment 10 receives a package 46 therewithin (FIG. 9), the ribbon-tie is pulled through the aperture 44, to gather the throat of the gift bag, then the ribbon-tie 32 is severed and tied into a bow 48. As a consequence of the gathering of the throat of the gift bag, the portion of the bag above the ribbon-tie falls into a petaled-flower-type of arrangement. Too, in that the flaps 20 and 26 are sealed together along the edges 34 thereof. the inner bottom of the gift bag defines a substantially flat surface. In the lay flat disposition (i.e., flat, empty disposition) of the gift bag, the joined flaps 20 and 26 define an inwardly-directed pocket at the bottom of the bag, and it is this pocket which, upon the package 46 being set into the bag, spreads out to define the aforesaid substantially flat surface in the bottom of the bag.

FIG. 6 depicts the upper portion of the rear panel **22*a* of an alternative embodiment 10*a* of the gift bag. In this embodiment, all aspects thereof are the same as in the embodiment 10, except for the ribbon-tie and the gathering of the throat of the gift bag. In this embodiment 10*a*, the ribbon-tie comprises two, separate lengths 32*a* and 32*b*. Length 32*a* (not shown) is confined within the channel 42 of the front panel 16, and heat-sealed, at the opposite ends thereof, to the lateral edges of panel 16. Length 32*b* is confined within the channel 42 of rear panel 22*a*, and the ends thereof, also, are heat-sealed at the lateral edges of panel 22*a*. In addition, panel 22*a* has another aperture 44*a* formed therein, opening onto the channel 42 and exposing ribbon-tie length 32*b*. In this embodiment of the gift bag, both lengths 32*a* and 32*b*** are pulled through their respective apertures 44 and 44*a*, severed, and tied into bows 48 on each side of the bag.

As described, gift bag embodiments 10 and 10*a* are formed from two sheets 12 and 14 of heat-sealable polymer film. In alternative embodiments, the gift bag is formable from single sheets of the film; such is represented in FIGS. 7 and 8.

In FIG. 7 is shown a single sheet of the aforesaid film which is folded up upon itself. It has an overall length of from approximately twelve to approximately two hundred and forty inches, and a width of from approximately two inches to approximately sixty-five inches, again, depending upon how large it is desired to have the gift bag. This sheet 50 comprises the same front and rear panels 16 and 22, end portions 18 and 24, and flaps 20 and 26, as in the embodiment 10, however the flaps 20 and 26 are joined in that the sheet 50 is of one continuous length. Here too, then, the terminal edges 28 of the end portions 18 and 24 are heat sealed to their own, respective panels 16 and 22, and again along a same seal line 40 (not shown here) to form the hems 30 and channels 42 for ribbon-tie lengths 32*a* and 32*b*. The lateral edges of the end portions 18 and 24, panels 16 and 22, and flaps 20 and 26 are heat-sealed together to define the bag with a closed bottom, closed sides, and only an open top. Panels 16 and 22, too, would have the same apertures 44 and 44*a* formed therein to provide access to the ribbon-tie lengths 32*a* and 32*b* for severing and tying of the bows 48.

The sheet 52 of the film, shown in FIG. 8 is used to carry out the formation of the novel gift bag, again. Here, however, the sheet 52 is folded across itself, and heat-sealed along the left-hand edges of the end portions 18 and 24, panels 16 and 22 and flaps 20 and 26, and as in the embodiment 10, the terminal edges 34 of the flaps are also heat-sealed together. Sheet 52 has a length of from approximately four inches to approximately one hundred and thirty inches, and a width of from approximately six inches to approximately one hundred and twenty inches. Without detailing the same explanations again, it will be understood that sheet 52 is also used to form the hems 30 and channels 42 for ribbon-tie lengths 32*a* and 32*b*.

While we have described our invention, in connection with specific embodiments thereof, it is to be clearly understood that this is done only by way of example, and not as a limitation to the scope of the invention, as set forth in the objects thereof, and in the appended claims. For instance, we show ribbon-ties and lengths thereof 32, 32*a* and 32*b*. Self-evidently, such could just as well be supplanted with yarn, cord, and the like. Too, the sheets 12, 14, 50 and 52 may be clear and transparent, translucent, or opaque, or of any color; more the sheets, i.e., the polymer films thereof, can be silver- or gold-metalized via coating. The sheets, also, may be printed upon with designs appropriate for the circumstances of the gift-giving and/or the gift recipient. All these, and other modifications and embelishments, which will occur to others, are deemed to be within the scope of the invention and the ambit of the claims.

We claim:

1. A gift bag, comprising:

a bag formed of two, overlying, rectangular sheets of flexible, compliant material sealed together along three, common edges thereof, namely: bottom edges and both sides edges, to define said bag with only an open top; wherein each of said sheets has a prescribed, overall length, and a prescribed, overall width which is from approximately thirty-three percent to approximately sixty-five percent of said length;

said sheets comprise front and rear, overlying panels having the aforesaid prescribed width, and a given length which is from approximately sixty-five percent to approximately eighty percent of said prescribed length;

an upper portion of said bag, extending from said open top thereof, having only dual thicknesses of said material for each sheet;

end portions of said sheets are folded back upon themselves only once, and are disposed in mutually confronting relationship, and terminal edges of said end portions are sealed to their respective sheets and thereacross;

said end portions form a hem in said upper portion of said bag;

said end portions, further, are sealed to their own, respective sheets, along a seal line which is parallel to said sealed terminal edges, to define, together with said sealed edges, a channel within said hem; and further including only a single tie wholly and slidably confined within said channel; and wherein one of said sheets is devoid of openings; and the other of said sheets has only one opening formed therein; wherein said opening comprises an aperture which opens onto said channel and exposes said tie.

2. A gift bag, according to claim 1, wherein:

at least one of said sheets has an aperture formed therein which opens onto said channel and exposes said tie.

3. A gift bag, according to claim 1, wherein:

a lower portion of said bag has dual thicknesses of said material.

4. A gift bag, according to claim 3, wherein:

said lower portion of said bag has a gusset formed thereat which defines an inwardly-directed pocket within said lower portion.

5. A gift bag, according to claim 4, wherein:

said pocket has a depth of from approximately one inch to approximately ten inches.

6. A gift bag, according to claim 1, wherein:

said hem has a width of from not less than approximately one inch to not more than approximately seventeen inches.

7. A gift bag, according to claim 1, wherein:

both of said sheets have apertures formed therein which open onto said channel and expose said tie.

8. A gift bag, according to claim 1, wherein:

each of said sheets have only one opening formed therein; and said openings comprise apertures which open onto said channel and expose said tie.

9. A gift bag, comprising:

a bag formed of a rectangular sheet of flexible, compliant material folded up upon itself, and sealed along two, aligned, opposite lateral edges thereof, to define said bag with closed sides, an open top, and a closed bottom; wherein said sheet has a prescribed, overall length, and a prescribed, overall width which is from approximately sixteen percent to approximately twenty-seven percent of said prescribed length;

said sheet comprises front and rear, overlying panels having the aforesaid prescribed width, and a given length which is from approximately thirty-three percent to approximately forty percent of said prescribed length;

an upper portion of said bag, extending from said open top thereof, having only dual thicknesses of said material for each panel which form a hem in said upper portion;

said dual thicknesses of material of each panel are sealed together, along a seal line which is parallel to said open top, to define a channel within said hem; and further including only a single tie wholly and slidably confined within said channel; and wherein one of said panels is devoid of openings; and the other of said panels has only one opening formed therein; wherein said opening comprises an aperture which opens onto said channel and exposes said tie.

10. A gift bag, comprising:

a bag formed of a rectangular sheet of flexible, compliant material folded across itself, and sealed along two, aligned, right-angular edges thereof, to define said bag with an open top, a closed bottom, and two closed sides; wherein said sheet has a prescribed, overall length, and a prescribed, overall width which is from one hundred and fifty percent to approximately ninety-two percent of said prescribed length;

said sheet comprises front and rear, overlying panels each having a given width which is half said prescribed length, and a given length which is from approximately sixty-six percent to approximately eighty percent of said prescribed width;

an upper portion of said bag, extending from said open top thereof, having only dual thicknesses of material for each panel to form a hem in said upper portion;

said dual thicknesses of material of each panel are sealed together, along a seal line which is parallel to said open top, to define a channel within said hem; and further including only a single tie wholly and slidably confined within said channel; and wherein one of said panels is devoid of openings; and the other of said panels has only one opening formed therein; wherein said opening comprises an aperture which opens onto said channel and exposes said tie.

* * * * *